United States Patent [19]

Pontoppidan

[11] Patent Number: 4,627,600

[45] Date of Patent: Dec. 9, 1986

[54] MECHANISM TO BE MOUNTED BETWEEN TWO PARTS, WHOSE MUTUAL DISTANCE MUST BE VARIABLE

[75] Inventor: Eskild Pontoppidan, Lyngby, Denmark

[73] Assignee: Flemming HVIDT Mobelarkitektfirma A/S, Denmark

[21] Appl. No.: 749,625

[22] PCT Filed: Oct. 16, 1984

[86] PCT No.: PCT/DK84/00100

§ 371 Date: Jun. 14, 1985

§ 102(e) Date: Jun. 14, 1985

[87] PCT Pub. No.: WO85/01645

PCT Pub. Date: Apr. 25, 1985

[30] Foreign Application Priority Data

Oct. 17, 1983 [DK] Denmark ..... 4784/83

[51] Int. Cl.[4] ..... B66F 3/00

[52] U.S. Cl. ..... 254/124

[58] Field of Search ..... 254/124, 8 R, 8 C, 9 R, 254/9 C, 10 R, 10 C; 108/147; 248/421, 404

[56] References Cited

FOREIGN PATENT DOCUMENTS 3108552 2/1982 Fed. Rep. of Germany .
2099447 3/1972 France .

*Primary Examiner*—Robert C. Watson
*Attorney, Agent, or Firm*—Bacon & Thomas

[57] ABSTRACT

A mechanism is described for mounting between two parts, such that the mutual distance between the parts may be varied. The mechanism includes a bar pivotally journalled in a bearing at one end and interconnected to an actuating device. The actuating device is pivotally suspended to one of the structures at one end and is connected to the bar at the other end. The pivot axis of the bearing extends obliquely to a plane containing the suspension point of the actuator and the point of connection between the actuator and the bar.

6 Claims, 4 Drawing Figures

Figure 1:
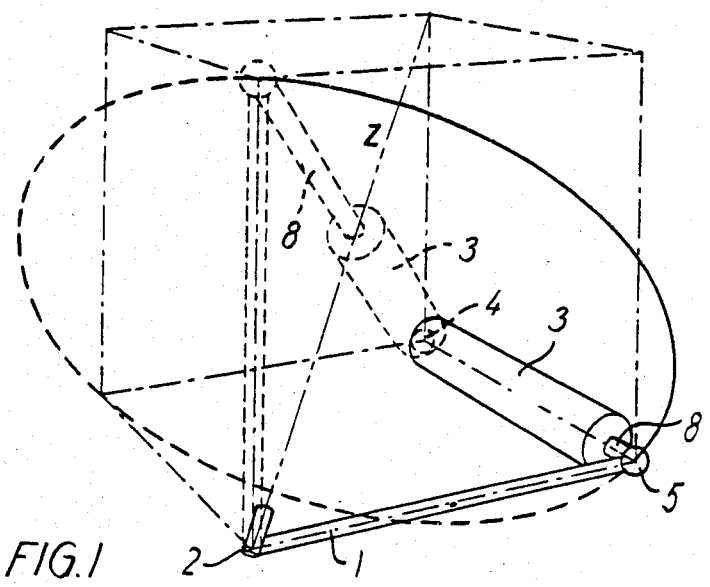

MECHANISM TO BE MOUNTED BETWEEN TWO PARTS, WHOSE MUTUAL DISTANCE MUST BE VARIABLE

The invention relates to a mechanism to be mounted between two parts, whose mutual distance must be variable, preferably against a load, e.g. the bottom and the frame of a bed, which mechanism has a bar pivotally journalled and connected with one of the parts at its one end, the bar being at its other end which acts upon e.g. is in rest with, the other part, or between its ends coupled with a pivotally suspended driving means of the elongation or extension type.

The last mentioned end of the bar can, for example, bear against and act on the under side of a load surface, e.g. a goods platform or the bottom of a bed, or on the upper side of a pressure plate, e.g. on the chassis of a goods platform or on the frame of a bed. On the actuation of the bar by the driving means the bar will turn in its bearing and with the end situated opposite the bearing it will press the surface against which it bears away from the bearing, e.g. upwards.

If the said bar, which in the above-mentioned example acts as a lifting bar in such mechanism, is journalled at one end like a hinge and at a distance therefrom or at its other end is connected with a driving means operative and situated in the longitudinal direction of the bar, only a very poor ratio can be obtained between the greatest lift and the minimum height of the mechanism, because the perpendicular component of the power of the driving means and thereby the lifting force becomes very poor or completely disappears if the bar is lowered towards or to a horizontal position on a level with the driving means. Such mechanism inclusive of the driving means will also have a relatively great total length.

The purpose of the invention is to produce a mechanism, especially a lifting mechanism, which has an extremely small height in the initial position, and which has also small dimensions in the longitudinal and latitudinal directions, at the same time permitting a powerful lift, also from a horizontal initial position.

In view of this, a mechanism of the kind dealt with above is characterized in that the driving means actuates the bar mainly transverse to its longitudinal direction, and in that the axis of the bearing of the bar extends obliquely in relation to a plane containing the connecting line between the suspension point of the driving means and its point of application on the bar.

As a result of the oblique bearing of the one end of the bar, the driving means when actuating the bar will always make the latter turn in its bearing, the opposite end of the bar describing a circular arc with its centre in the axis of the bearing. This also applies even though in the initial position the bar is on a level with the driving means, thereby permitting the very low height.

The lifting capability expressed as the relationship between the lifting movement and the travel of the driving means, particularly the extension of the driving means, depends partly on the angularity of the axis of the bearing.

In an embodiment of the mechanism according to the invention in which the axis of the bearing follows the direction of a spatial diagonal in an equilateral cube having the bar as a lateral edge and having the driving means extending along a lateral edge at a right angle thereto on a level with the bar in the initial position, the maximum lifting movement, during which the bar is moved from a horizontal to a perpendicular position, will with a suitable mounting of the driving means result in an elongation of this to $\sqrt{3}$ times the lifting movement, that is, an elongation by approx. 73%, as will be made more explicit below.

A mechanism according to the invention has a multitude of possible applications. By virtue of its short height, it can as stated be mounted between the frame and the bottom of a bed and serve as a bed lift, particularly in a sickbed, but it can for example also be used to lift goods and other material for transport, e.g. on a goods platform, from ground level to loading height at the platform of a truck such as a lorry or van or a goods waggon. Also by mutual displacement between two parts on non-perpendicular planes, e.g. on a horizontal plane, can a mechanism according to the invention be used analogously, e.g. to actuate machine parts to sideways displacement against an elastic force.

Further details of the invention are given below partly on the basis of a skeleton diagram in FIG. 1 and two schematic presentations of a lifting mechanism in FIGS. 2 and 3.

Figure 4:
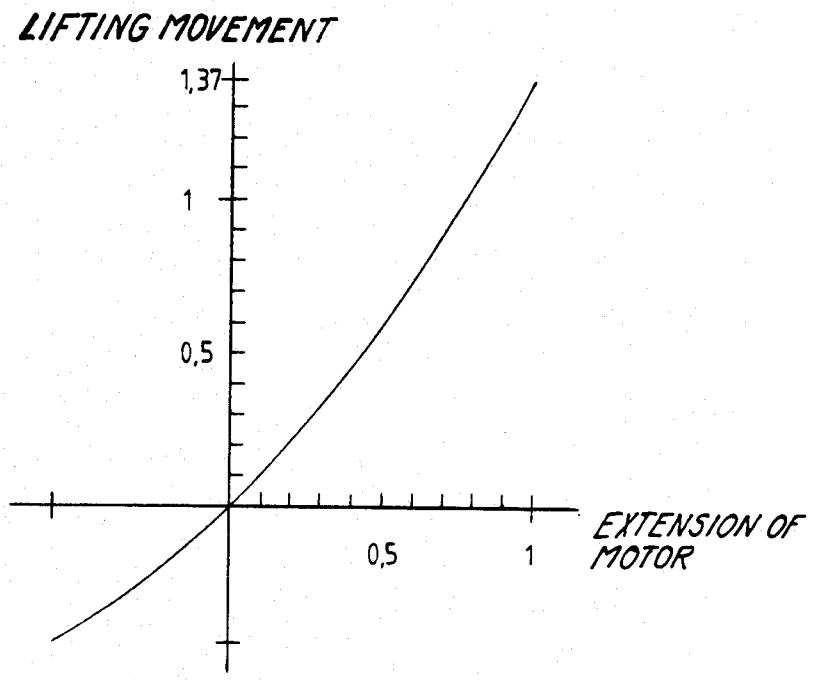

FIG. 4 is a graphic presentation of the lifting movement as a function of the elongation of the driving means.

In FIG. 1 the actuating or lifting bar 1 is shown schematically with full-drawn lines in the lowered initial position. At one end the bar 1 is pivotally journalled with a bent end part in a tilted bearing 2 in the form of a short pipe section, and at its opposite end the bar 1 is connected via an universal joint 5 with a driving means 3 in the form of an extension or elongation motor, which is shown by full-drawn lines in the likewise horizontal initial position. At the end situated opposite the point of connection with the bar 1, the extension motor is pivotally suspended in another universal joint 4.

By an extension or elongation motor is here meant a motor which on activation from the initial position shown by full-drawn lines increases its length, as shown by dotted lines on the drawing, e.g. by a spindle 8 being pushed out of the motor housing by mechanical, hydraulic or pneumatic means.

In the embodiment shown by way of example the bar 1 in the initial position forms a lateral edge in an imaginary equilateral cube, and the driving means 3 forms or lies along another side edge at a right angle thereto and in the same horizontal plane. The axis direction of the bearing 2 follows the direction of a spatial diagonal in the cube as indicated by a double dot-and-dash line Z, i.e. the bearing 2 could as regards function analogously lie on the extension of the diagonal beyond the cube.

When the driving means 3 is activated from the position shown by full-drawn lines, it actuates the bar 1 to turn in the bearing 2, and the free bar end positioned opposite the bearing 2 will describe a circular arc with the bearing 2 as the centre. Owing to the tilted bearing 2 the projection of the orbit of rotation on a plane containing the perpendicular lateral face of the cube, whose bottom limitation is formed by the bar 1, or on a plane at right angles thereto, will be an ellipse as indicated in the sketch. For the actual lifting movement the part of the ellipse is used which is drawn with a full-drawn line and which corresponds to a circular arc of 120° in the shown example.

The mechanism according to the invention is notable in that the bar 1 and the motor 3 in the horizontal initial position lie substantially in the same plane, which gives the mechanism an extremely low height in the initial position. Still, despite this position of the lifting bar and driving means, the latter, as a result of the tilted bearing 2, is able to move the bar 1 out of the initial position and along the above-mentioned orbit to the end position shown by dotted lines. The fact that this is possible has to do with the first part of the movement from the initial position having a considerably horizontal component in relation to the perpendicular component, which on the other hand later predominates, as also appears from the sketch.

If the length of the bar 1 in FIG. 1 and thereby the edge length of the imaginary cube is designated by a, the lifting height will also be a, and in the end position the motor 3 will be extended to a $\sqrt{3}$, namely $\sqrt{a^2+(a^2+a^2)}$, i.e. an extension of approx. 73%.

Figure 2:
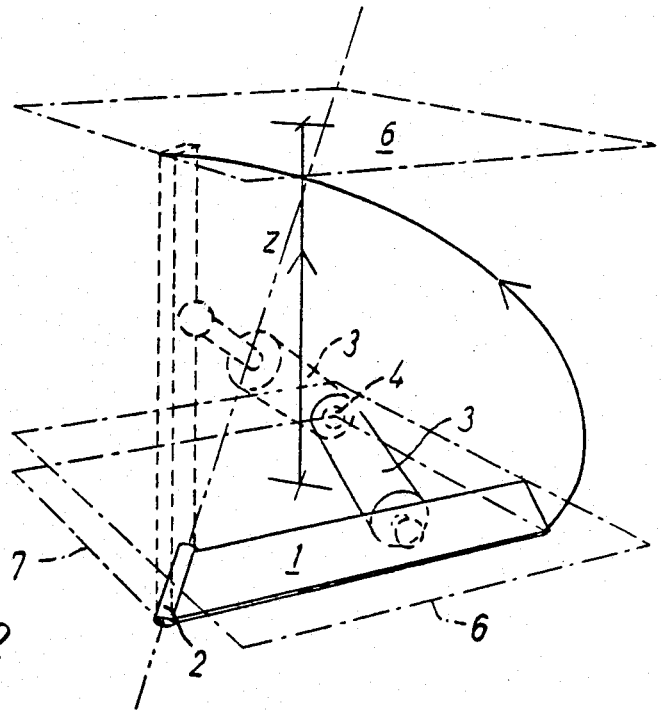

In a practical lifting mechanism, shown in FIG. 2, and in which the tubular bearing 2 in FIG. 1 is replaced by an axle journal taking a corresponding course, which is attached to a frame 7 bearing the mechanism and indicated merely by dot-and-dash lines, and which co-operates with a bore in the bar 1, the free end of the lifting bar 1 is in rest with the under side of a lifting surface 6, likewise indicated with dot-and-dash lines, which can for instance serve to take up goods or materials to be lifted up to a certain height, e.g. with a view to transferring them to the platform of a lorry, or which can analagously be a pressure plate on the lower side of the bottom of a bed, which must be able to be lifted.

The bar 1 bears against the lifting surface 6 with a slide bearing, which during the movement of the bar from the position shown by full-drawn lines to the one shown by dotted lines in FIG. 2 moves under this lifting surface, thereby pressing it upwards. The bar end or the slide bearing, respectively, thereby follow an orbit on the under side of the lifting surface which forms part of an ellipse.

The bar end can in a manner not shown be formed like a metal ball, which slides against a metal sheet on the under side of the lifting surface in direct rest against this metal sheet or with an interjacent thrust pad or foot of plastic, which with a dome-formed part encircling slightly more than half of the ball is pivotally mounted on this, and which has a plane surface in rest against said metal sheet. FIG. 2 also shows that the motor 3 is connected to the lifting bar 1 a short distance away from the latter's free end, which for instance in the manner just described bears against the under side of the lifting surface 6.

No guide has been shown in FIG. 2 for the lifting surface 6 shown with dot-and-dash lines in the lateral direction, because such guide is not a part of the invention, but the surface 6 can for instance be guided by means of any collapsible mechanism, e.g. of the jaw-tongs type.

The relative placing shown in FIG. 1 of the bearing 2, the bar 1, the driving means 3 and the universal or cardan joints 4 and 5 thus, as stated, serve only as an example which results in a fairly compact and efficient lifting mechanism, but other placings of one or more of the said parts, e.g. as shown in FIG. 2, and other angles for the axis of the bearing 2 are possible without any alteration in the fundamental invention. However, as regards the tilted position of the bearing 2, it should be noted that under all stages of operation the bearing axis must be oblique in relation to or intersect an arbitrary plane containing the line of connection between the point of suspension 4 of the driving means 3 and the the driving means' point of application 5 on the lifting bar 1, such that the direction of the power from the driving means 4 never becomes parallel to the direction of the bearing axis. The axis of the bearing 2 may expediently extend into a space which is cube-formed and having the bar 1 in the horizontal initial position as an edge on a side which in its plane contains the point of suspension 4 of the driving means 3, e.g. a cube as shown in FIG. 1 or one of the three other possible cubes with the bar 1 as lateral edge and with a lateral surface in a plane containing the point of suspension 4.

It is also possible for the movable part of the driving means 3, the spindle 8, not to be wholly drawn into the motor housing in the initial position shown in FIG. 1. On continued retraction of the spindle 8, the bar end will continue a short distance downwards along the orbit of the ellipse as indicated. This continued movement, which can for instance correspond to the movement along a circular arc of 60°, can in certain cases be exploited, e.g. if the lifting mechanism serves as a bed lift and in the course of its main movement lifts and lowers the bottom of a bed in relation to its frame. The continued movement of the bar end will then be able to be exploited for separate lifting and lowering of the bed head as desired by means of a suitable system of rods.

Figure 3:
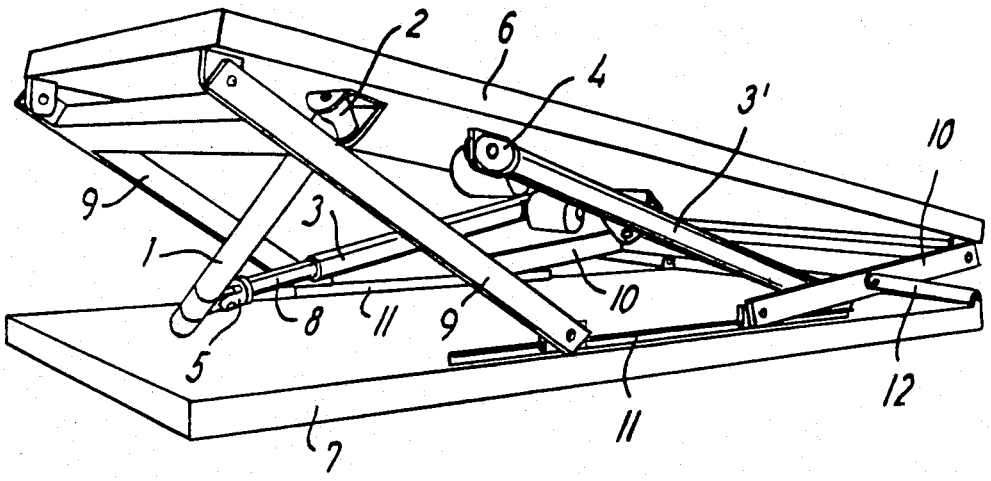

FIG. 3 shows a practical embodiment of a bed lift having two motors complete with lift bars. Parts equivalent to those shown in FIGS. 1 and 2 bear corresponding reference marks. Of the hindmost mechanism, to the right in FIG. 3, is seen only the motor 3', the remainder of this mechanism being hidden behind other parts.

The motors 3,3' are here pivotally mounted in universal joints 4, only one of which is visible, on the under side of a lifting surface 6, which is here the bottom of a bed. Correspondingly, the lifting bars 1, again only one of which is visible, are pivotally mounted in bearings 2 on the under side of the bottom of the bed, and their free ends are in rest against the bed frame or against a pressure plate (not shown) on the bed frame, which is designated 7, because it corresponds to the stationary part 7 in FIG. 2.

The motors 3 and 3' can be activated independently of each other in the shown example, so that the bottom 6 of the bed can be made to assume arbitrary oblique positions as desired.

The bottom 6 of the bed can be guided by means of a system of rods which is adapted according to the purpose in question, in the shown example by rods 9, 10, which co-operate with slide rails 11 on the bed frame 7, and of which the bars 10 are also coupled with the bed frame via a toggle joint 12. As a matter of fact the guidance for the lifting surface, the bottom 6 of the bed, can be formed by skilled persons in accordance with a desired lifting function.

I claim:

1. Mechanism to be mounted between two parts, whose mutual distance must be variable, preferably against a load, e.g. the bottom and the frame of a bed, which mechanism has a bar (1) pivotally journalled in a bearing (2) and connected with one of the parts of one end, the bar also being coupled with a pivotally suspended (4) driving means (3,8) wherein the driving means (3,8) actuates the bar (1) substantially transverse to its longitudinal direction, and wherein the axis of the bearing (2) of the bar (1) extends obliquely in relation to a plane containing the connecting line between a suspension point (4) of the driving means (3,8) and its point of application on the bar (1).

2. Mechanism according to claim 1, wherein the axis of the bearing (2) extends into a space which is cube-formed and has the bar (1) as a lateral edge.

3. Mechanism according to claim 1 wherein the axis of the bearing (2) follows the direction of a spatial diagonal in an equilateral cube, having the bar (1) as a lateral edge and having the driving means extending along a lateral edge at right angles thereto in the same plane as the bar (1) in the initial position.

4. Mechanism according to claim 1 wherein the driving means (3,8) is coupled to the bar (1) at an end of the bar (1) opposite the bearing (2).

5. Mechanism according to claim 1 wherein the driving means (3,8) is coupled to the bar (1) between the one end and an opposite end.

6. Mechanism according to claim 1 wherein the driving means (3,8) is a pivotally suspended actuator.

* * * * *